US007213370B2

(12) United States Patent
Dedrich et al.

(10) Patent No.: US 7,213,370 B2
(45) Date of Patent: May 8, 2007

(54) WINDOW REGULATOR

(75) Inventors: Paul Martin Dedrich, Grand Blanc, MI (US); Casimir R. Kiczek, Gray, GA (US)

(73) Assignee: Dura Global Technologies, Inc., Rochester Hills, MI (US)

( * ) Notice: Subject to any disclaimer, the term of this patent is extended or adjusted under 35 U.S.C. 154(b) by 0 days.

(21) Appl. No.: 11/218,275

(22) Filed: Aug. 31, 2005

(65) Prior Publication Data

US 2006/0042167 A1 Mar. 2, 2006

Related U.S. Application Data

(60) Provisional application No. 60/606,458, filed on Sep. 1, 2004.

(51) Int. Cl.
*E05F 11/00* (2006.01)

(52) U.S. Cl. ..... 49/358

(58) Field of Classification Search ..... 49/348, 49/349, 358, 502

See application file for complete search history.

(56) References Cited

U.S. PATENT DOCUMENTS 2,293,968 A * 8/1942 Chandler et al. ..... 335/177
3,640,022 A * 2/1972 Kouth et al. ..... 49/420
4,700,508 A * 10/1987 Kollner et al. ..... 49/352
4,878,391 A * 11/1989 Komatsu et al. ..... 74/89.2
4,908,988 A * 3/1990 Yamamura et al. ..... 49/358
4,967,510 A * 11/1990 Torii et al. ..... 49/358
5,537,782 A * 7/1996 Klippert et al. ..... 49/358
5,970,658 A * 10/1999 Smith ..... 49/352
6,389,753 B1 * 5/2002 Fenelon ..... 49/348
6,430,874 B1 * 8/2002 Korte ..... 49/358
6,751,905 B1 * 6/2004 Daumal Castellon ..... 49/352
6,820,369 B2 * 11/2004 Fenelon ..... 49/349
6,966,149 B2 * 11/2005 Fenelon ..... 49/375

* cited by examiner

*Primary Examiner*—Jerry Redman
(74) *Attorney, Agent, or Firm*—Richard M. Mescher; Porter Wright Morris & Arthur; Dean B. Watson

(57) ABSTRACT

A closure assembly for a motor vehicle includes a closure member, a guide track and a carrier operably secured to the guide track for movement along the guide track and carrying the closure member therewith. A rack has a plurality of teeth and extends along the guide track. A pinion gear is carried by the carrier and has teeth engaging the rack. A motor is operably connected to the pinion gear to selectively move the closure member from one position to another. The carrier includes at least one engagement member biased into engagement with the guide track to prevent binding of the carrier with the guide track and to maintain contact between the pinion gear and the rack.

20 Claims, 7 Drawing Sheets

WINDOW REGULATOR

CROSS-REFERENCE TO RELATED APPLICATIONS

This application claims priority benefit of U.S. Provisional Patent Application No. 60/606,458 filed on Sep. 1, 2004, the disclosure of which is expressly incorporated herein in its entirety by reference.

STATEMENT REGARDING FEDERALLY SPONSORED RESEARCH

Not Applicable

REFERENCE TO MICROFICHE APPENDIX

Not Applicable

FIELD OF THE INVENTION

The present invention generally relates to window regulators and, more particularly, to a gear actuated window regulator for moving a closure member such as a window from one position to another.

BACKGROUND OF THE INVENTION

Motor vehicles such as automobiles typically include a window lift assembly or "window regulator" for raising and lowering windows in doors or other body panels. These window regulators can be manual or powered. Such window regulators are also used for opening and closing other types of closure members in motor vehicles such as, for example, "sunroofs", rear windows, and the like. Many powered closure mechanism have been proposed using a rack and pinion gear to move sliding closures in motor vehicles. See, for example, U.S. Pat. Nos. 2,115,632, 2,336,530, 4,119,341, 4,167,834, 4,235,117, 4,389,818, 4,908,988, 4,967,510, 5,537,782, and 5,577,347, the disclosure of which are expressly incorporated herein in their entireties by reference.

While these prior closure mechanisms may adequately open and close closure members in motor vehicles, they all require a relatively large number of parts and are relatively complex to manufacture and assemble. Additionally, there is an ongoing desire for motor vehicle components such as closure mechanisms to be smaller, lighter, and lower cost. Accordingly, there is a need in the art for an improved closure mechanism for opening and closing a closure member of a motor vehicle.

SUMMARY OF THE INVENTION

The present invention provides a closure assembly for a motor vehicle which overcomes at least some of the above-noted problems of the related art. According to the present invention, a closure assembly comprises, in combination, a closure member, a guide track, a carrier operably secured to the guide track for movement along the guide track and carrying the closure member therewith, a rack having a plurality of teeth extending along the guide track, a pinion gear carried by the carrier and having teeth engaging the rack, and a motor operably connected to the pinion gear to selectively move the closure member from one position to another. The carrier includes at least one engagement member biased into engagement with the guide track to preventing binding of the carrier with the guide track.

According to another aspect of the present invention, a closure assembly for a motor vehicle comprises, in combination, a closure member, a guide track, a carrier operably secured to the guide track for movement along the guide track and carrying the closure member therewith, a rack having a plurality of teeth extending along the guide track, a pinion gear carried by the carrier and having teeth engaging the rack, and a motor operably connected to the pinion gear to selectively move the closure member from one position to another. The carrier includes at least one engagement member biased into engagement with the guide track to maintain contact between the pinion gear and the rack.

According to another aspect of the present invention, a closure assembly for a motor vehicle comprises, in combination, a closure member, a guide track, a carrier operably secured to the guide track for movement along the guide track and carrying the closure member therewith, a rack having a plurality of teeth extending along the guide track, a pinion gear carried by the carrier and having teeth engaging the rack, and a motor carried by the carrier and operably connected to the pinion gear to selectively move the closure member from one position to another. The guide track includes a pair of flanges extending in opposite directions and the carrier includes at least two guide shoes forming channels facing one another and receiving the flanges of the guide track so that the carrier is movable along the flanges in a longitudinal direction of the guide track and relative movement between the carrier and the guide track is limited in directions perpendicular to the longitudinal direction of the guide track. Each guide shoe is provided with at least one engagement member biased into engagement with the guide track to preventing binding of the carrier with the guide track From the foregoing disclosure and the following more detailed description of various preferred embodiments it will be apparent to those skilled in the art that the present invention provides a significant advance in the technology and closure mechanism for motor vehicles. Particularly significant in this regard is the potential the invention affords for providing a high quality, reliable, small and lightweight, low cost, and relatively quiet mechanism. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 1:
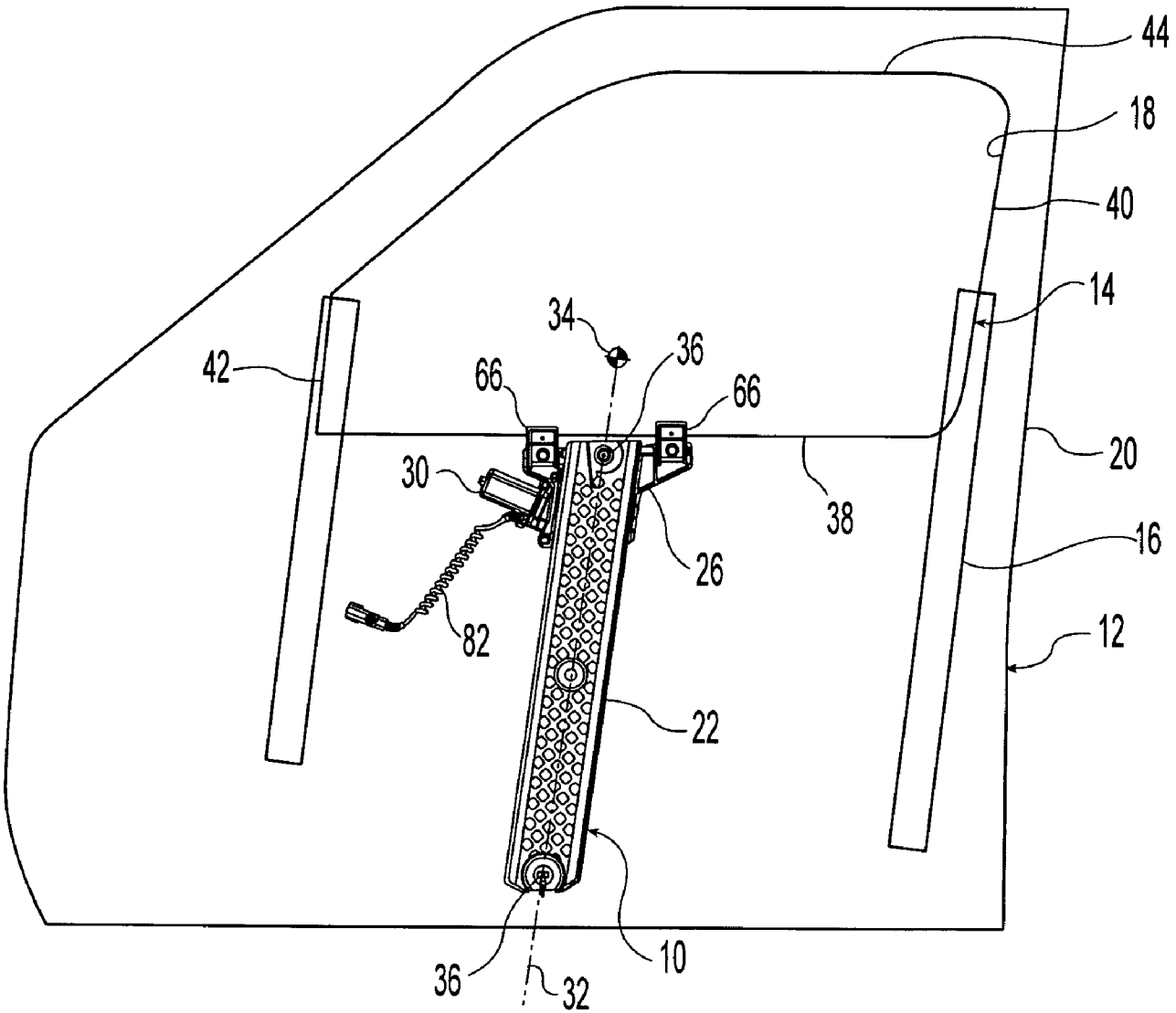
FIG. 1 is an inner side elevational view of a closure mechanism mounted in a motor vehicle door according to a preferred embodiment of the present invention, wherein components are removed for clarity.

It should be understood that the appended drawings are not necessarily to scale, presenting a somewhat simplified representation of various preferred features illustrative of the basic principles of the invention. The specific design features of closure mechanisms for motor vehicles as disclosed herein, including, for example, specific dimensions, orientations, locations, and shapes will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the closure mechanism illustrated in the drawings. In general, up or upward refers to an upward direction within the plane of the paper in FIG. 1 and down or downward refers to a downward direction within the plane of the paper in FIG. 1. Also in general, fore or forward refers to a direction toward the front of the motor vehicle, that is, toward the left within the plane of the paper in FIG. 1 and aft or rearward refers to a direction toward the rear of the motor vehicle, that is, to the right within the plane of the paper in FIG. 1.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved closure mechanisms disclosed herein. The following detailed discussion of various alternative and preferred embodiments will illustrate the general principles of the invention with reference to a powered closure mechanism for a window of a motor vehicle door. Other embodiments suitable for other applications, such as, for example hand-operated mechanisms, mechanisms for other types of motor vehicle closures such as sun roofs, rear windows, and the like, and/or mechanisms for other types of closures will be apparent to those skilled in the art given the benefit of this disclosure.

Referring now to the drawings, closure mechanisms or assemblies for motor vehicles according to the present invention are disclosed. The illustrated embodiments of the present invention are particularly adapted for opening and closing a closure member such as, for example, a sliding window or panel for motor vehicles. The term motor vehicles is used herein and in the claims to mean a powered device for carry passengers, goods or equipment such as, for example, automobiles, passenger cars and trucks, self-propelled recreational vehicles, commuter vehicles, vans and mini-vans, sport utility vehicles (SUV's), cross-over vehicles, medium and heavy duty trucks, busses, self-propelled farm, industrial and construction equipment, and the like. Additionally, the term motor vehicles is used to include off road vehicles such as, for example dune buggies, golf carts, trains, airplanes, boats, and ships and the like.

As shown in FIG. 1 a closure mechanism or regulator 10 according to a preferred embodiment of the present invention is installed in a motor vehicle 12 for moving a closure member 14 between open and closed positions. The illustrated closure member 14 is a window supported by a guide frame 16. The illustrated closure mechanism 10 raises and lowers the closure member 14 along the guide frame 16 to open and close an opening 18 in the illustrated hinged door 20 of the motor vehicle 12. It is noted that the closure member 14 can alternatively be used to open and close any other suitable motor vehicle opening such as, for example, a roof opening, an opening in the structure of the motor vehicle, or a sliding door or panel including a backlight.

The illustrated closure member 14 is moved by a single regulator or closure mechanism 10 having a single rack and pinion. The illustrated closure mechanism includes 10 a guide track 22, a rack 24 extending along the guide track 22, a lift plate or carrier 26 securable to the closure member 14 and movable along the guide track 22 to move the closure member 14, a pinion gear 28 carried by the lift plate 26 and engageable with the rack 24 to move along the rack 24 and the lift plate 26 along the guide track 22 when the pinion gear 28 rotates, and a motor 30 operatively connected to the pinion gear 28 for selectively rotating the pinion gear 28. The illustrated closure mechanism 10 moves the sliding closure member 14 over a path adjacent and parallel to, but spaced-apart from, a longitudinally-extending axis 32 of the guide track 22 between a full up or closed position wherein the door opening 18 is closed (shown in FIG. 1) and a full down or open position wherein the door opening 18 is at least partially open (not specifically shown). A center of gravity 34 of the closure member 14 is preferably located adjacent to the longitudinal axis 32 of the guide track 22 to reduce any unbalanced forces or torque on the guide track 22 and/or the rack 24. The closure mechanism 10 can position the closure member 14 at any position between the full open and closed positions to vary the degree to which the closure member 14 opens/closes the door opening 18. The illustrated closure member 14 is slightly curved and moves along a slightly curved path relative to the motor vehicle door 20 as taught in U.S. Pat. No. 4,167,834, the disclosure of which is expressly incorporated herein in its entirety by reference. It is noted however, that the closure member 14 can alternatively be substantially straight and moved along a substantially straight path (best shown in FIG. 14). The closure mechanism 10 can be secured to and/or supported by the door 18 or other structure of the motor vehicle in a conventional manner. The illustrated closure mechanism 10 is secured to the door 10 with mechanical fasteners 36 located near ends of the guide track 22 but any other suitable securing means can alternatively be utilized.

The illustrated closure member 14 is a window has a bottom edge 38, a first or rear side edge 40, a second or front side edge 42, and a top edge 44. The top edge 44 includes a segment that is generally horizontal and forwardly extends from the first side edge 40 and a second segment that tapers downwardly from the first segment at an angle toward the second side edge 42. The first and second side edges 40, 42 are parallel to each other but are skewed slightly with respect to the bottom edge 38 and are not perpendicular thereto. More specifically, the first side edge 40 forms a obtuse angle with respect to the bottom edge 38 and the second side edge 42 forms an acute angle with respect to the bottom edge 38. The illustrated closure member 14 is curved from the top edge 44 to the bottom edge 38 and forms a concave inner surface 46 and a convex outer surface 48. The center of gravity or mass 34 is located in a plane running through the center of mass of the closure member 14 and parallel to the side edges 40, 42. The plane bisects the closure member 14 into sections of equal weight. The illustrated closure member 14 is formed of a transparent glass but can alternatively be formed of any other suitable material.

The closure member 14 is disposed in the door 18 that includes first and second guide slots of the guide frame 16 for guiding the first and second side edges 40, 42 of the closure member 14, respectively, along a generally vertical movement path in either an upward direction to close the opening 18 in the door 20 or a downward direction to open the opening 18 in the door 20 as the closure mechanism 10 moves the closure member 14 as described in more detail hereinafter. The guide slots and frames 16 are parallel to the plane bisecting the center of mass 34 of the closure member 14, the longitudinal axis 32 of the guide track 22, and the side edges 40, 42 of the closure member 14. The structure of the guide slots and guide frame 16 are well known in the art and will not be described in detail herein.

The closure mechanism 10 is best seen in FIGS. 2 to 9. The illustrated guide track 22 is an elongate member forming the central longitudinal axis 32 that extends within the plane bisecting the center of mass 34 of the closure member 14. In cross section (best shown in FIG. 7), the guide track 22 includes a main wall 50 and a pair of end walls 52 perpendicularly extending from ends of the main wall 50 to form an interior channel 56. Also included in cross-section, are a pair of opposed guide flanges 54 perpendicularly extending in opposite, outward directions from the free ends of the end walls 52 so that the guide flanges 54 are in the same plane. The illustrated end walls and flanges 52, 54 extend the entire longitudinal length of the guide track 22. The illustrated guide track 22 is slightly curved to match the curvature of the closure member 14. Ends of the guide track 22 are provided with openings 58 for receiving the mechanical fasteners 36 that secure the guide track 22 to the door 20.

The guide track 22 is of a flexible construction to permit the guide track 22 to bend in a direction toward and away from the side edges 40, 42 of the closure member 14 as well as in a direction perpendicular to the inner surface 46 of the closure member 14. The guide track 22 is also moderately flexible in the lengthwise direction to allow the guide track 22 to bend and absorb shock as the closure member 14 reaches a fully closed or open position. The guide track 22 is maintained sufficiently rigid, however, to support the weight of the closure member 14 and to withstand torque caused by the interaction of the pinion gear 28 and the rack 24 without buckling. Thus, the guide track 22 could also be described as semi-rigid. An entirely rigid guide track 22 requires that shock be absorbed by teeth of the rack 24 and the pinion gear 28, thus requiring a more expensive rack and pinion gear. The guide track 22 can be formed of any suitable material but preferably comprises a reinforced injection molded thermoplastic wherein the base resin (polymer) is preferably from a crystalline family like polyamide, polyacetal, or polyester.

The illustrated rack 24 includes a vertical row of horizontally extending teeth 60 for engagement by the pinion gear 28 as described in more detail hereinafter. The illustrated rack 24 is located at the forward end wall of the guide track channel 56 and facing in a rear direction toward the rear edge 40 of the closure member 14 and thus extends parallel to the central longitudinal axis 32 of the guide member 22. The illustrated rack 24 is formed as a unitary, one-piece component with the guide track 22 but the rack 24 can alternatively be formed as a separate component.

The illustrated lift plate or member 26 supports the closure member 14 and operatively engages the guide track 22 to move along the guide track 22 to raise and lower the closure member 14. The illustrated lift plate 26 has a generally planar main wall 62 positioned adjacent to the guide track 22 and partially covering the channel 56. The main wall 62 forms a pair of outwardly extending wings 64 at its upper end to support and connect the closure member 14. The illustrated closure member 14 is secured to each of the wings 64 by clamping members 66 which are secured to the wings 64 by mechanical fasteners 68 and clamp the bottom edge 38 of the closure member 14. Thus, the closure member 14 is located directly above the lift plate main wall 62 and is secured to the lift plate 26 for movement therewith.

To maintain engagement between the lift plate 26 and the guide track 22, the illustrated lift plate 26 is provided with slides or guide shoes 70 which extend about the flanges 54 of the guide track 22 so that lift plate 26 substantially surrounds the guide track 22 to interlock and secure the lift plate 26 to the guide track 22. The illustrated lift plate 26 is provided with two slides 70 on each side but any other suitable quantity of slides 70 can be utilized. The illustrated slides 70 include an end wall 72 perpendicularly extending from the main wall 62 of the lift plate 26 (and parallel and offset from the guide track end walls 52) and flanges 74 perpendicularly extending from free ends of the main wall 62 (and perpendicular to the end walls 52 of the guide track 22) in an inward direction toward one another and toward the end walls 52 of the guide track 22. Formed in this manner, the slides 70 form inwardly facing channels 75 on opposite sides of the lift plate 26 that are sized to receive the guide track flanges 54 therein so that the lift plate 26 can freely move in a longitudinal direction along the guide track 22 but movement of the lift plate 26 relative to the guide track 22 is limited in directions perpendicular to the longitudinal direction.

The pinion gear 28 is indirectly supported and carried by the lift plate 26 and is engageable with the rack 24 to move the pinion gear 28 along the rack 24 and the lift plate 26 along the guide track 22 when the pinion gear 28 rotates. The pinion gear 28 includes a plurality of teeth 76 about its outer periphery and is located within the channel 56 of the guide track 22 so that the teeth 76 are operatively engaged with the teeth 60 of the rack 24.

Figure 9:
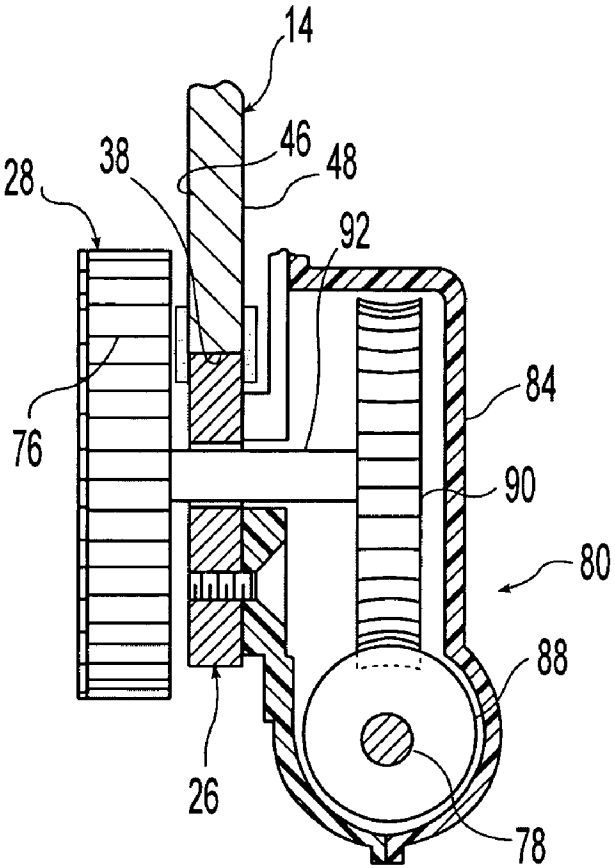
FIG. 9 is an enlarged, fragmented, rear elevational view, partially in cross-section, similar to FIG. 8 and further showing the drive assembly of the closure mechanism of FIG. 7, wherein components are removed for clarity.
Figure 8:
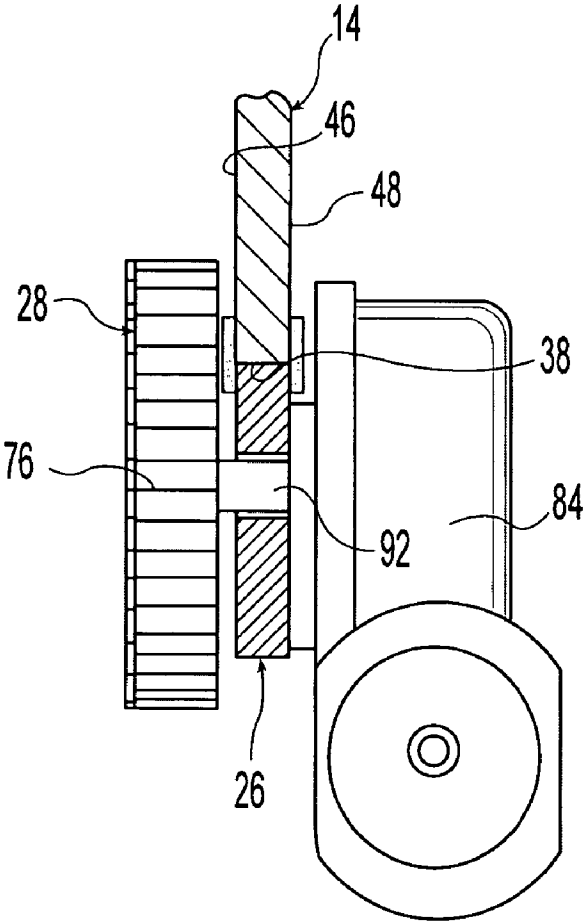
FIG. 8 is an enlarged, fragmented, rear elevational view, partially in cross-section, of a drive assembly of the closure mechanism of FIG. 7, wherein components are removed for clarity.

The motor 30 is also supported and carried by the lift plate 26 and includes an output shaft 78 that is operably connected to the pinion gear 28 by suitable gearing 80. The illustrated motor 30 is provided with suitable wire connections 82 to a suitable control module and vehicle power. The illustrated motor 30 is secured to the lift plate 26 by a housing or mounting bracket 84 secured to lift plate 26 with mechanical fasteners 86. As best shown in FIGS. 8 and 9, the output shaft 78 of the motor 30 is provided with a worm gear 88 that engages a driven gear 90 within the housing 84 so that the driven gear 90 rotates upon rotation of the motor output shaft 78. The driven gear 90 is supported by a central shaft 92 within the housing 84 that is perpendicular to the motor output shaft 78. The central shaft 92 extends from the center of the driven gear 90 to the center of pinion gear 28 so that the pinion gear 28 rotates with the driven gear 90. Mounted in this manner, the pinion gear 28 rotates upon rotation of the motor output shaft 78. The motor 30 and gearing 80 can be of any suitable type such as, for example, see U.S. Pat. No. 6,145,252, the disclosure of which is expressly incorporated herein in its entirety by reference.

The pinion gear 28 is indirectly supported by the lift plate 26 on the first side 46 of the closure member 14 and the motor 30 is supported by the lift plate 26 on the second side 48 of the closure member 14. The illustrated pinion gear 28 is supported immediately adjacent the inner side 46 of the closure member 14. The outer hub of the pinion gear 28 preferably overlaps the bottom edge 38 of the closure member 14. The illustrated motor 30 has an inside edge that is preferably as close as possible to outer surface 48 of the closure member 14 without extending beyond the outer surface 48.

Figure 11:
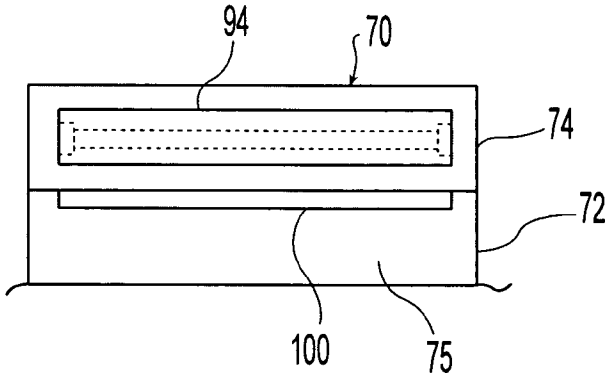
FIG. 11 is an end elevational view of the slide of FIG. 10.
Figure 10:
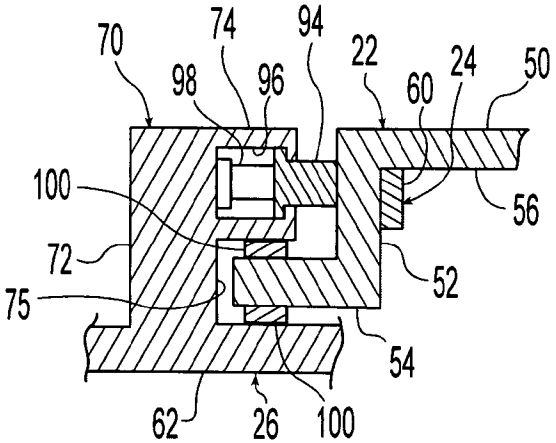
FIG. 10 is an enlarged, cross-sectional view taken along line 10—10 of FIG. 4.

As best shown in FIGS. 10 and 11, the illustrated sliders or guide shoes 70 are provided with spring-loaded engagement or slide members 94 that maintain engagement between the sliders 70 and the end walls 52 of the guide track 22 to further maintain engagement between the rack 24 and the pinion gear 28. Each illustrated slider 70 is provided with an elongate slot or cavity 96 located in the free edge of the slider flange 74 so that the open end of the cavity 96 faces the end wall 52 of the guide track 22. The engagement member 94 is movably secured within the cavity 96 and a biasing or spring member 98 resiliently urges the engagement member 94 away from the slider 70 and toward the guide track end wall 52 so that the spring-loaded engagement members 70 take-up any side-to-side clearance or gap between the rack 24 and the pinion gear 28. Additionally, the spring-loaded engagement members 70 also minimize any tendency of the closure member 14 to cock by providing a biasing force that is normal to the pinion gear and track engagement so as to urge the teeth 76 of the pinion gear 28 with the teeth 60 of the rack 24. The illustrated biasing or spring member 98 is a wave spring but it is noted that any other suitable type or form of biasing or spring member can alternatively be utilized.

Because the biasing member 98 urges the engagement member 94 away from the slider or guide shoe 70 and into engagement with the guide track 22, it is preferable to minimize friction between the engagement members 94 and the guide track 22. This can be accomplished by coating at least one of the engagement surfaces of the engagement member 94 and the guide track 22 with a low friction material such as, for example, polytetrafluoroethylene (PTFE) or Teflon, which is a trademark of Dupont. Alternatively, the engagement member 94 or a portion thereof can be formed entirely of a low friction material such as, for example PTFE. Additionally, the engagement members 94 can be adapted for rolling contact with the guide track 22 rather than the illustrated sliding contact. Because the central plane of the closure member 14 is offset relative to the central planes of the sliders 70 and the pinion gear 28, the illustrated lift plate 26 is provided with a pair of pads or spacers 100 on opposite sides of the guide track flanges 54 and oriented at ninety degrees to the contact of the engagement member 94 with the guide track 22 and the contact of the pinion gear 28 with the rack 24 to prevent cocking of the closure member 14. Optionally, a suitable low friction material such as, for example, PTFE may be provided on the sliding contact surfaces or the pads 100 can be entirely formed of a low friction material such as, for example, PTFE. It is noted that the pads 100 can be eliminated if desired. Thus, the engagement members 94 and the pads 100 in conjunction with the guide track 2 provide fore-and-aft and side-to-side stability (relative to the vehicle) for movement of the pinion gear 28 as it engages and moves along the rack 24. By providing a low friction material on the engagement members 94 and/or the pads 100, the rack and pinion operates smoothly and the power requirement to operate the rack and pinion is reduced.

Figure 13:
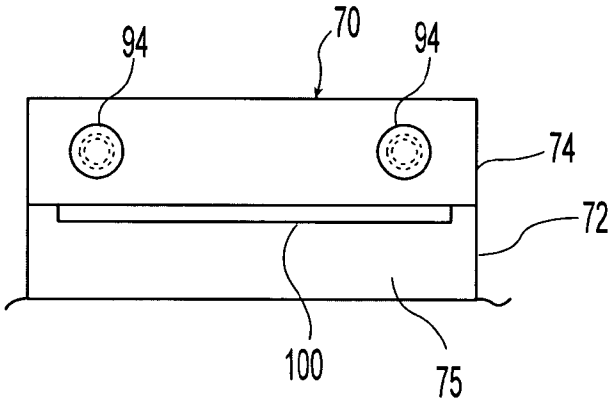
FIG. 13 is an end elevational view of the slide of FIG. 12.
Figure 12:
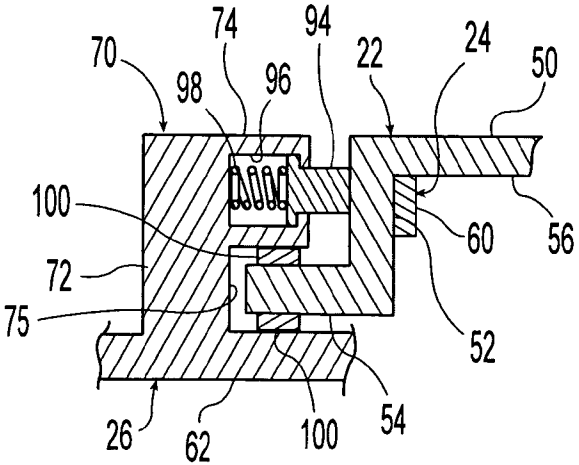
FIG. 12 is an enlarged, cross-sectional view similar to FIG. 10 but showing a variation of the slide.

As best shown in FIGS. 12 and 13, the engagement members 94 can alternatively be in the form of at least two vertically spaced apart buttons with the biasing or spring members 98 in the form of coil springs disposed in the spaced apart cavities 96. The coil springs can be cylindrical or conical depending on the biasing force required by the application requirements. This variation illustrates that the spring-biased engagement members 94 can have other forms.

When the operator desires to move the closure member 14, the operator presses an operator input device (not shown) in the required direction for a predetermined time interval and then releases the device. The device sends a signal to a control module (not shown) that in turn sends a signal to a switch which provides electrical current to the motor 30 so that the motor output shaft 78 rotates in one direction or the other as desired. Rotation of the motor output shaft 78 rotates the worm gear 88 which in turn rotates the driven gear 90. The pinion gear 28 rotates with the driven gear 90 through the shaft 92. As the pinion gear 28 rotates it moves along the rack 24 and moves the lift plate 26 and the closure member 14 secured thereto. This permits the closure member 14 to selectively move between its full up and full down positions as desired. Optionally, a sensor(s) monitors rotation of the motor output shaft 78 and power band of the motor 30 is measured to ensure that proper power requirements are being used to permit the closure member 14 to be moved from the full down position to the full up position or any intermediate position desire by the operator and to prevent pinching of a human limb or appendage.

Figure 14:
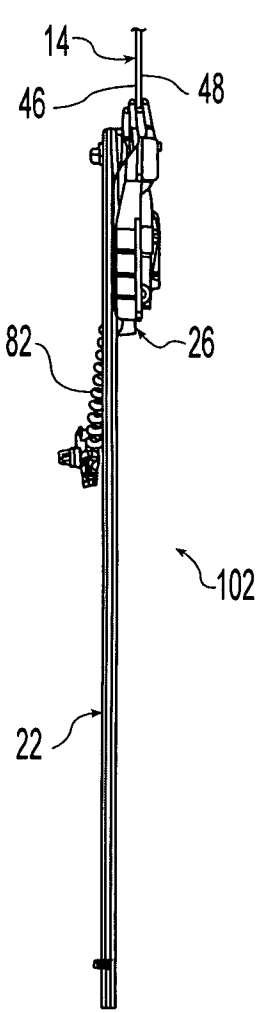
FIG. 14 is a rear elevational view similar to FIG. 3 but showing a closure mechanism according to a second embodiment of the present invention.
Figure 3:
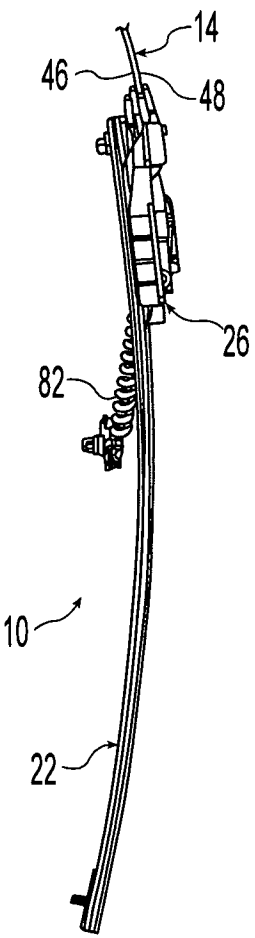
FIG. 3 is a rear elevational view of the closure mechanism of FIG. 2.
Figure 2:
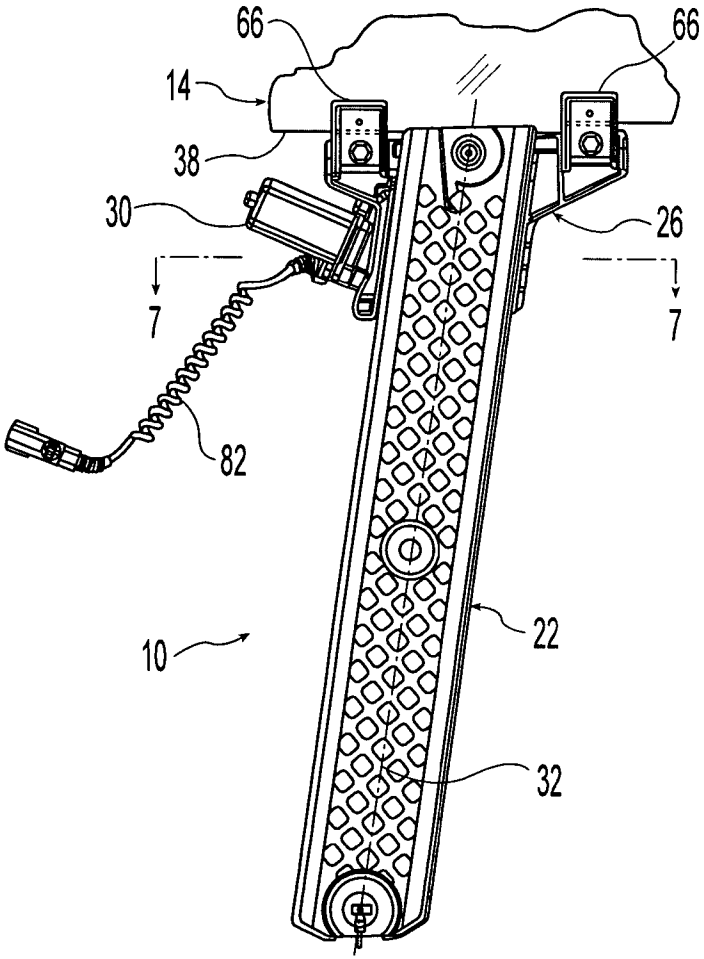
FIG. 2 is an enlarged inner side elevational view of the closure mechanism of FIG. 1.
Figure 4:
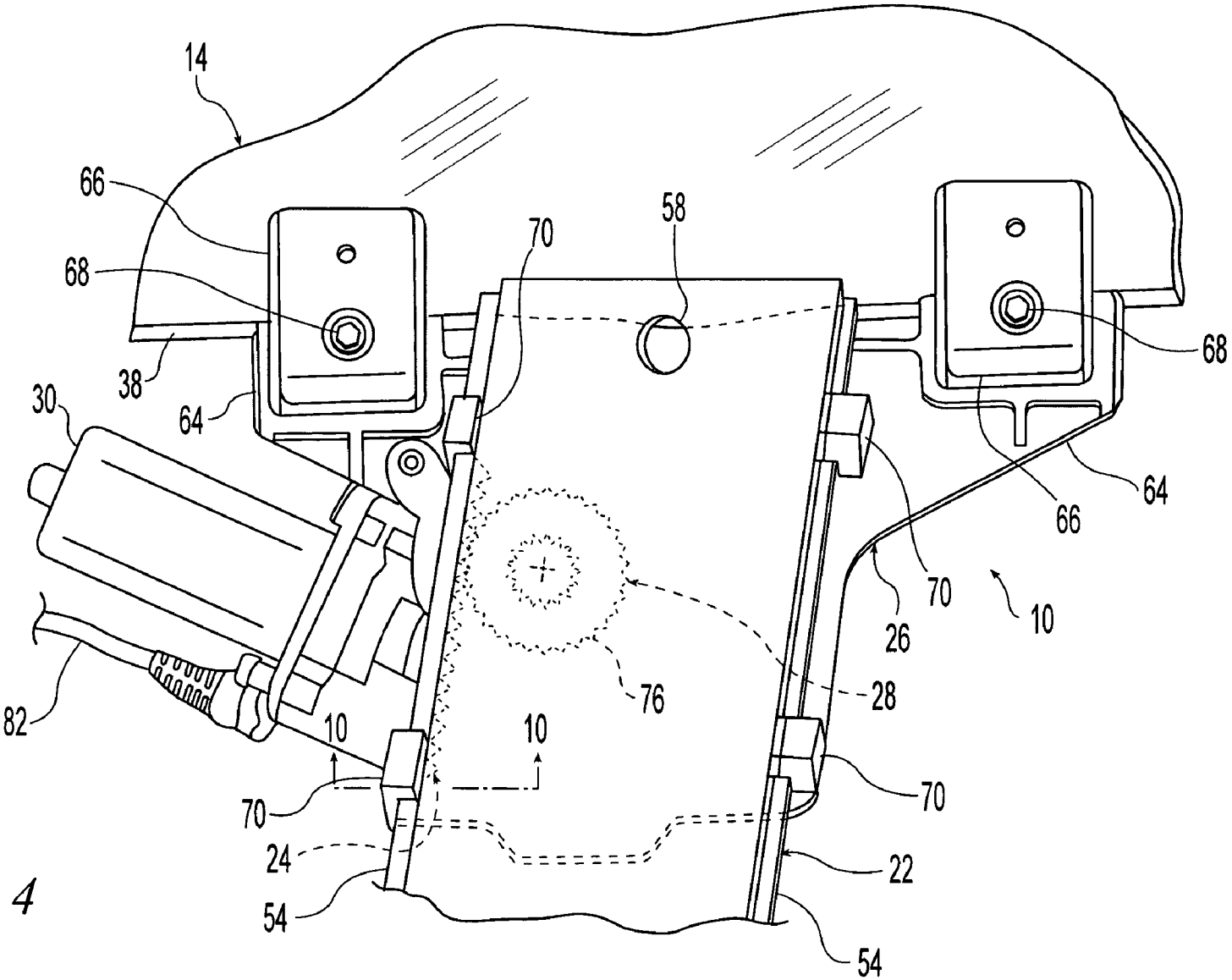
FIG. 4 is an enlarged, fragmented, inner side elevational view of an upper portion of the closure mechanism of FIGS. 2 and 3.
Figure 5:
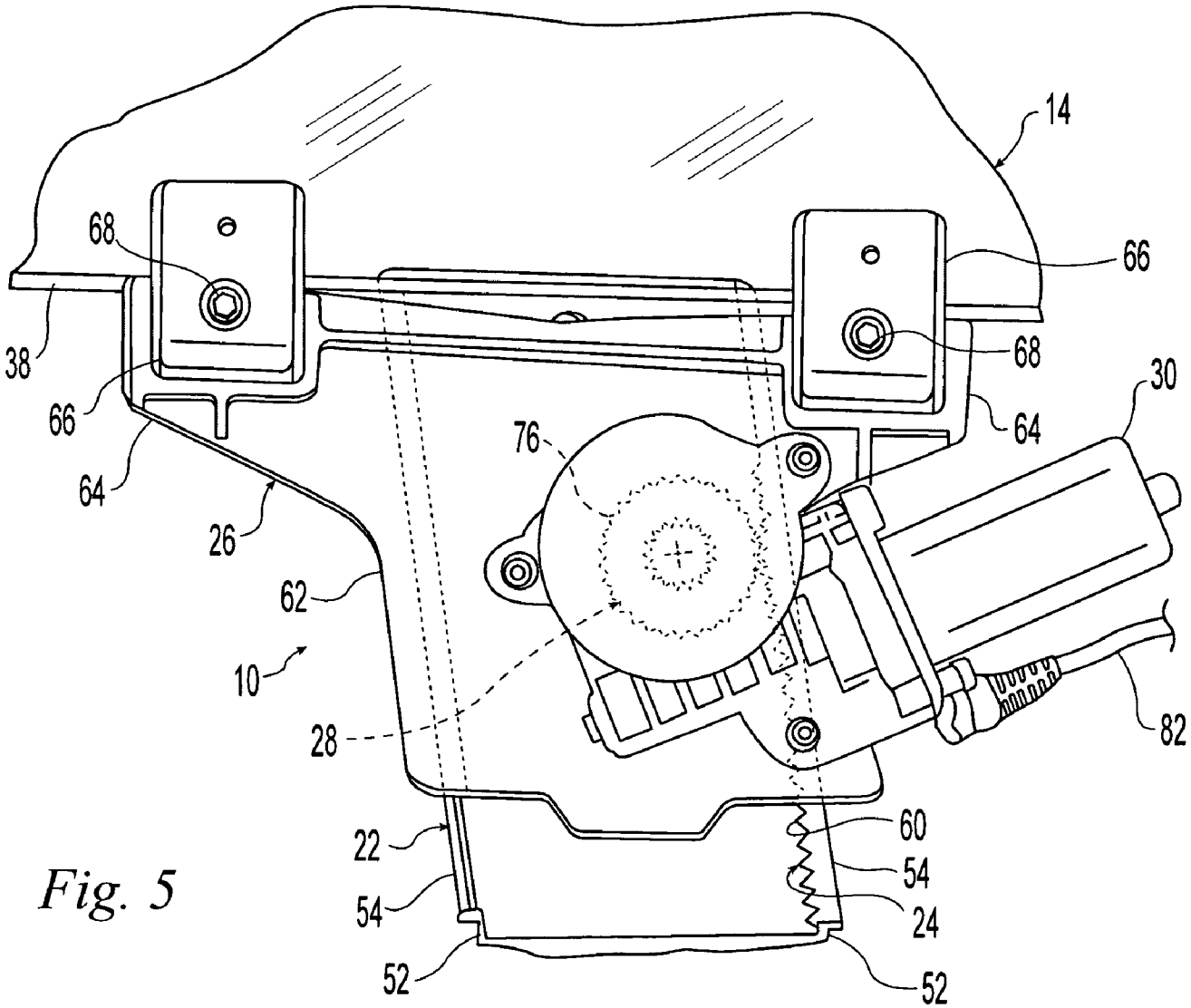
FIG. 5 is an enlarged, fragmented, outer side elevational view of an upper portion of the closure mechanism of FIGS. 2 to 4.
Figure 6:
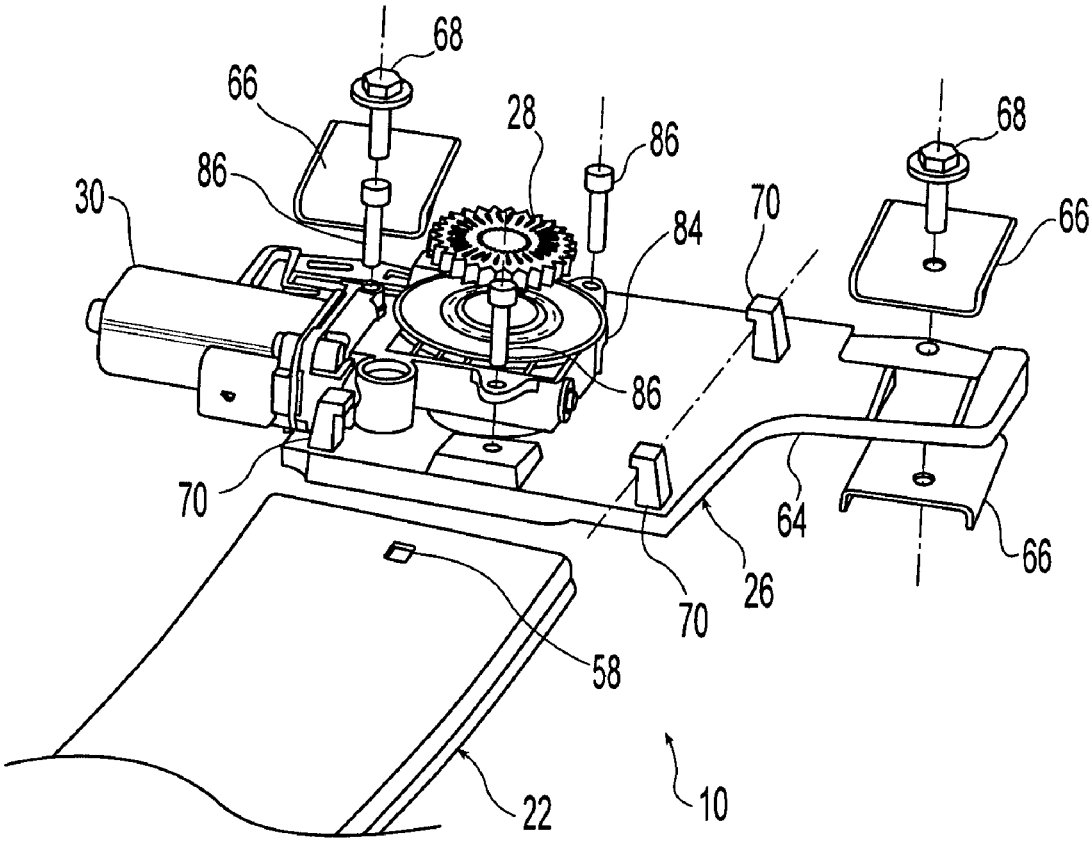
FIG. 6 is an exploded perspective view of an upper portion of the closure mechanism of FIGS. 2 to 5.
Figure 7:
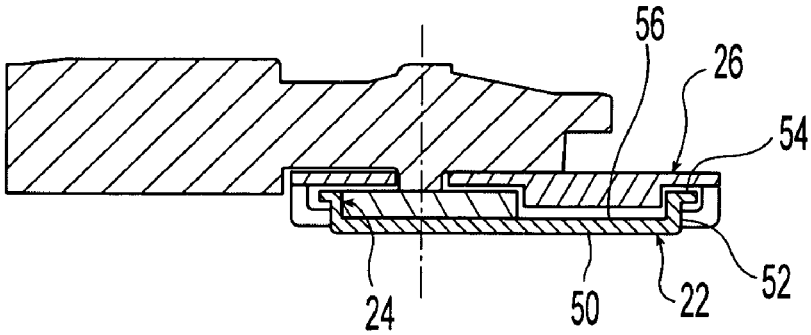
FIG. 7 is an enlarged, cross-sectional view taken along line 7—7 of FIG. 2.

FIG. 14 illustrates a closure mechanism 102 according to a second embodiment of the present invention which is substantially identical to the first embodiment described above in detail except that it is adapted for moving a generally planar closure member 14 along a generally straight path. This illustrates that the closure mechanism 10, 104 of the present invention can be utilized with closure members 14 having other forms.

From the foregoing disclosure and detailed description of certain preferred embodiments, it is also apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A closure assembly for a motor vehicle comprising, in combination:

a closure member;

a guide track;

a carrier operably secured to the guide track for movement along the guide track and carrying the closure member therewith;

a rack having a plurality of teeth extending along the guide track;

a pinion gear carried by the carrier and having teeth engaging the rack;

a motor operably connected to the pinion gear to selectively move the closure member from one position to another; and wherein the carrier includes at least one engagement member movable relative to the carrier and biased into engagement with the guide track in a direction to take-up any side-to-side gap between the rack and the pinion gear and prevent binding of the carrier with the guide track as the carrier moves along the guide track.

2. The closure assembly according to claim 1, wherein the engagement member maintains contact between the pinion gear and the rack.

3. The closure assembly according to claim 2, wherein the carrier is provided with a plurality of the engagement members.

4. The closure assembly according to claim 1, wherein the carrier is provided with a plurality of the engagement members on opposite sides of the guide track.

5. The closure assembly according to claim 1, wherein the motor is carried by the carrier.

6. The closure assembly according to claim 1, wherein the guide track forms a longitudinally extending channel and the rack and the pinion gear are located within the channel.

7. The closure assembly according to claim 6, wherein the rack and the guide member are formed in unitary one-piece construction.

8. The closure assembly according to claim 1, wherein the engagement member is biased into engagement with the guide member by a spring member.

9. The closure assembly according to claim 8, wherein the spring member is one of a leaf spring and a coil spring.

10. The closure assembly according to claim 8, wherein the engagement member and the spring member are secured in a cavity formed in the carrier.

11. The closure assembly according to claim 1, wherein the engagement member is in sliding contact with the guide member.

12. The closure assembly according to claim 11, wherein at least one contact surface of the engagement member and the guide member comprises a low friction material.

13. The closure assembly according to claim 1, wherein the engagement member engages the guide member in a direction parallel to the closure member and perpendicular to a direction of movement of the closure member.

14. The closure assembly according to claim 13, wherein at least one pad is provided between the carrier and the guide member in a direction perpendicular to the closure member and perpendicular to the direction of movement of the closure member.

15. The closure assembly according to claim 14, wherein at least one contact surface of the pad and the guide member comprises a low friction material.

16. The closure assembly according to claim 1, wherein at least one pad is provided between the carrier and the guide member in a direction perpendicular to the closure member and perpendicular to the direction of movement of the closure member.

17. The closure assembly according to claim 1, wherein the guide track includes a pair of flanges extending in opposite directions and the carrier includes at least two guide shoes forming channels facing one another and receiving the flanges of the guide track so that the carrier is movable along the flanges in a longitudinal direction of the guide track and relative movement between the carrier and the guide track is limited in directions perpendicular to the longitudinal direction of the guide track.

18. The closure assembly according to claim 1, wherein the rack and the pinion gear are the only rack and pinion gears moving the closure member.

19. A closure assembly for a motor vehicle comprising, in combination:

a closure member;

a guide track;

a carrier operably secured to the guide track for movement along the guide track and carrying the closure member therewith;

a rack having a plurality of teeth extending along the guide track;

a pinion gear carried by the carrier and having teeth engaging the rack;

a motor operably connected to the pinion gear to selectively move the closure member from one position to another; and wherein the carrier includes at least one engagement member movable relative to the carrier and biased into engagement with the guide track in a direction normal to the engagement between the pinion gear and the rack to maintain contact between the pinion gear and the rack as the carrier moves along the guide track.

20. A closure assembly for a motor vehicle comprising, in combination:

a closure member;

a guide track;

a carrier operably secured to the guide track for movement along the guide track and carrying the closure member therewith;

wherein the guide track includes a pair of flanges extending in opposite directions and the carrier includes at least two guide shoes forming channels facing one another and receiving the flanges of the guide track so that the carrier is movable along the flanges in a longitudinal direction of the guide track and relative movement between the carrier and the guide track is limited in directions perpendicular to the longitudinal direction of the guide track;

a rack having a plurality of teeth extending along the guide track;

a pinion gear carried by the carrier and having teeth engaging the rack;

a motor carried by the carrier and operably connected to the pinion gear to selectively move the closure member from one position to another; and wherein each guide shoe is provided with at least one engagement member movable relative to the carrier and biased into engagement with the guide track in a direction to take-up any side-to-side gap between the rack and the pinion near and prevent binding of the carrier with the guide track as the carrier moves along the guide track.

* * * * *